United States Patent [19]

Brown

[11] 3,977,034

[45] Aug. 31, 1976

[54] METHOD AND APPARATUS FOR FORM FITTING SHOES AND BOOTS

[76] Inventor: Dennis N. Brown, 8528 Custer School Road, Custer, Wash. 98240

[22] Filed: Mar. 21, 1975

[21] Appl. No.: 560,740

[52] U.S. Cl. ..... 12/142 R; 12/115.2

[51] Int. Cl.[2] ..... A43D 9/00

[58] Field of Search ..... 12/115.2, 115.4, 142 R, 12/142 Q

[56] References Cited

UNITED STATES PATENTS

| | | | |
|---|---|---|---|
| 1,024,869 | 4/1912 | Smith | 12/115.2 |
| 1,289,927 | 12/1918 | Schevitz | 12/115.2 |
| 2,086,917 | 7/1937 | Lattemann | 12/115.2 |

*Primary Examiner*—Patrick D. Lawson
*Attorney, Agent, or Firm*—Blair & Brown

[57] ABSTRACT

The method of form fitting shoes and boots of the instant invention is directed to the heating of the area of the foot gear which needs to be enlarged to accommodate the foot and simultaneously applying pressure from the inside of the foot gear to cause the heated portion of the foot gear to expand the desired amount. Pneumatically or hydraulically actuated cylinders are used within the foot gear to provide the required pressure and a number of different shoe contacting members are interchangeable to assist in shaping the expanded portion of the foot gear.

1 Claim, 21 Drawing Figures

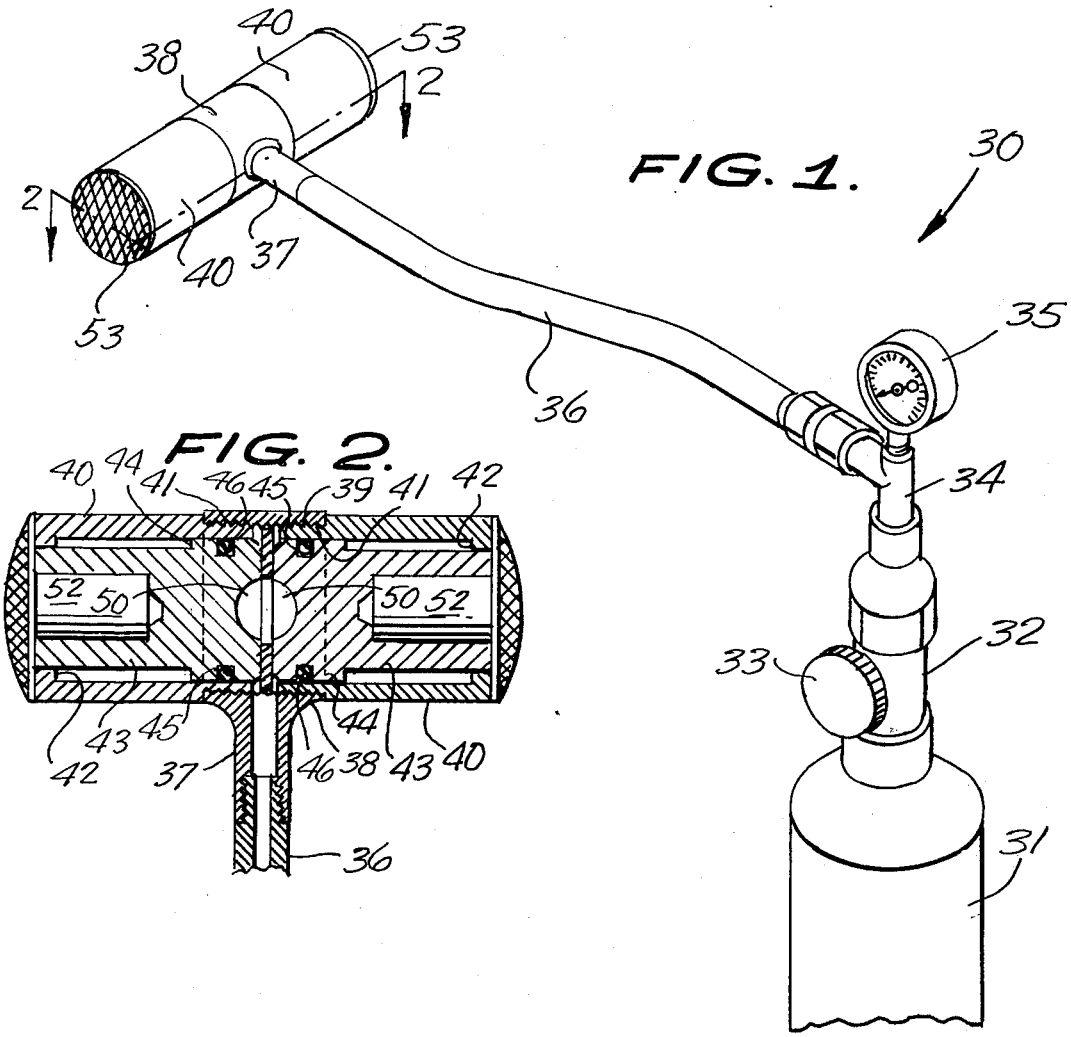
FIG. 1.
30
35
34
32
33
31
36
37
38
40
53
2
FIG. 2.
40
44
41
46
45
39
42
52
50
43
37
38
36
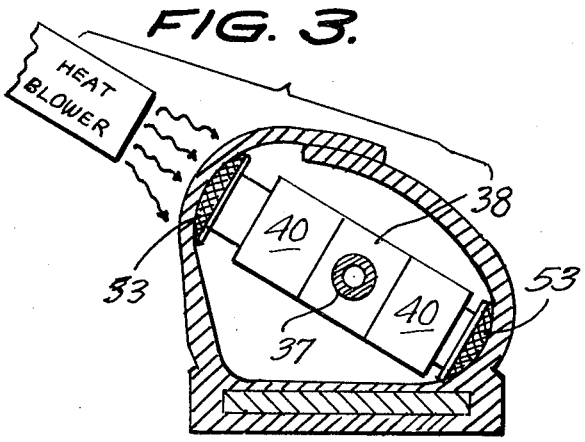
FIG. 3.
HEAT BLOWER
38
40
37
53
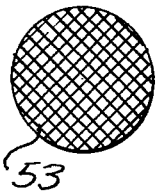
FIG. 4.
53
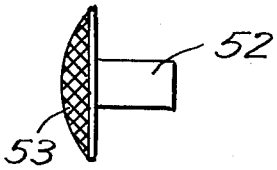
FIG. 5.
52
53
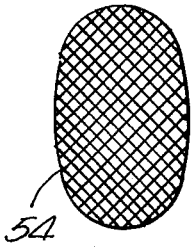
FIG. 6.
54
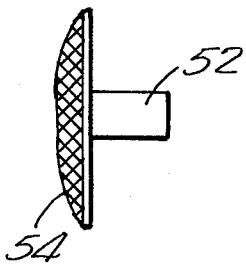
FIG. 7.
52
54

METHOD AND APPARATUS FOR FORM FITTING SHOES AND BOOTS

BACKGROUND OF THE INVENTION

1. FIELD OF THE INVENTION

The present invention relates to a method and apparatus for locally enlarging foot gear so as to adapt the foot gear to the foot of the wearer.

The primary object of the invention is to provide a method and apparatus for permanently enlarging a local portion of a foot gear to adapt it to the foot of the user.

Other objects and advantages will become apparent in the following specification when considered in light of the attached drawings.

BRIEF DESCRIPTION OF THE DRAWINGS

FIG. 1 is a perspective view of the apparatus used in the method of form fitting foot gear;

FIG. 2 is an enlarged fragmentary sectional view taken on the line 2—2 of FIG. 1, looking in the direction of the arrows;

FIG. 3 is a sectional view of the apparatus in use in a ski boot;

FIG. 4 is an elevational view of one of the forming pads used with the method;

FIG. 5 is a side elevation of the pad shown in FIG. 4;

FIG. 6 is an elevation view of another pad used with the method;

FIG. 7 is a side elevation of the pad shown in FIG. 6;

DESCRIPTION OF THE PREFERRED EMBODIMENTS

Figure 8:
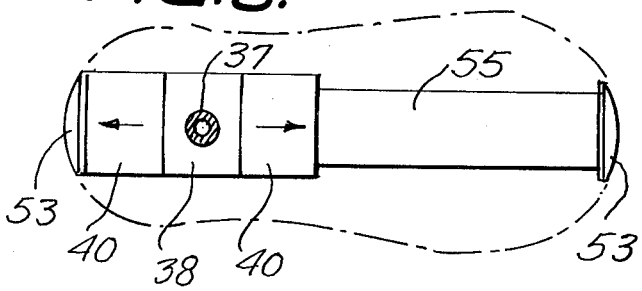
FIG. 8 is a sectional view of the apparatus with an extension applied thereto.
Figure 9:
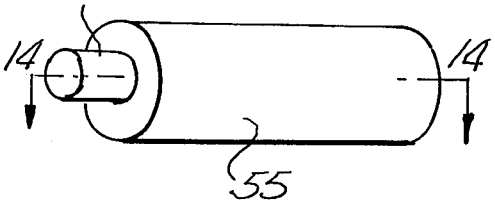
FIG. 9 is a perspective view of the extension used in FIG. 8.
Figure 10:
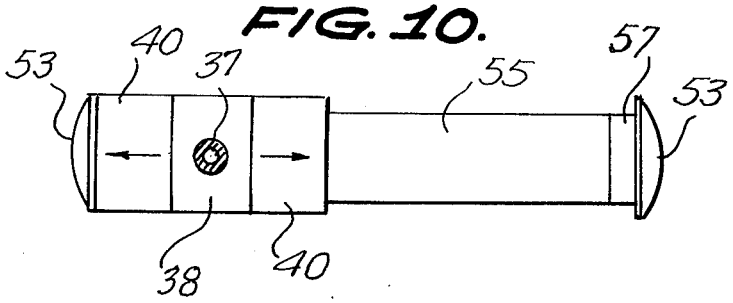
FIG. 10 is a view similar to FIG. 8 of another attachment.
Figure 11:
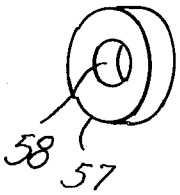
FIG. 11 is a perspective view of the attachment illustrated in FIG. 10.
Figure 12:
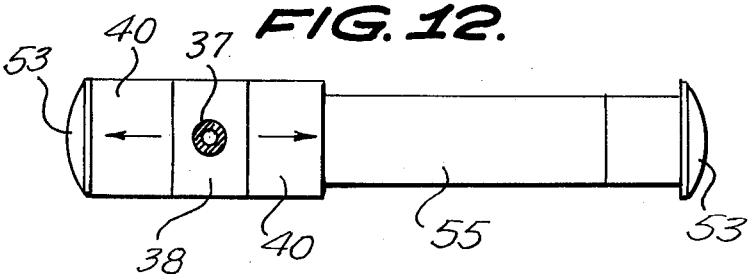
FIG. 12 is a view similar to FIG. 8 of still another attachment.
Figure 13:
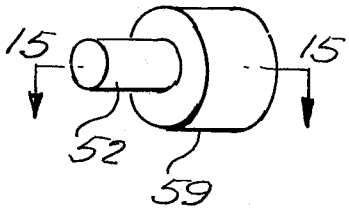
FIG. 13 is a perspective view of the attachment illustrated in FIG. 12.
Figure 14:
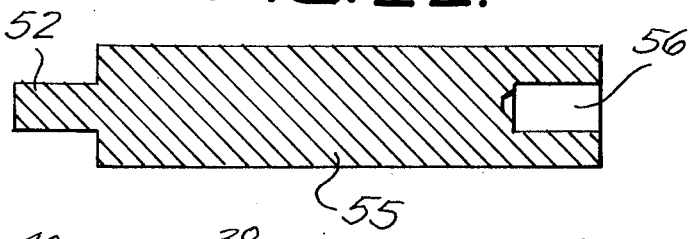
FIG. 14 is a longitudinal sectional view taken along the line 14—14 of FIG. 9, looking in the direction of the arrows.
Figure 15:
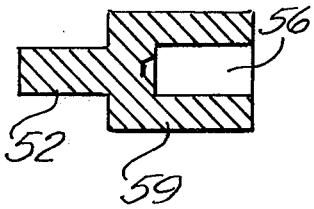
FIG. 15 is a longitudinal sectional view taken on the line 15—15 of FIG. 13, looking in the direction of the arrows.
Figure 16:
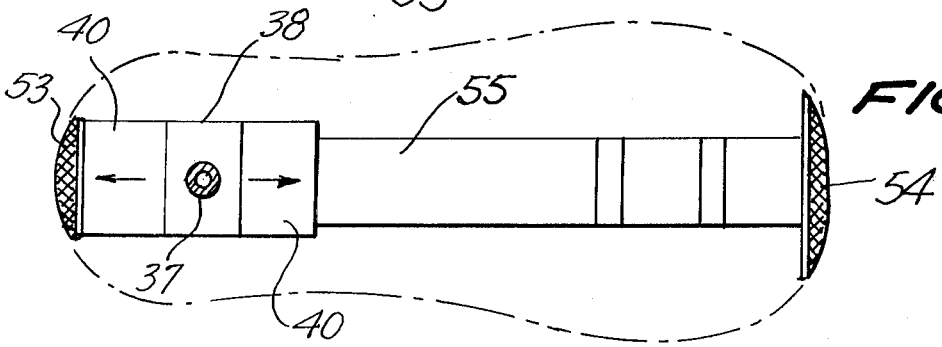
FIG. 16 is a view similar to FIG. 3 with several of the attachments shown in use.
Figure 17:
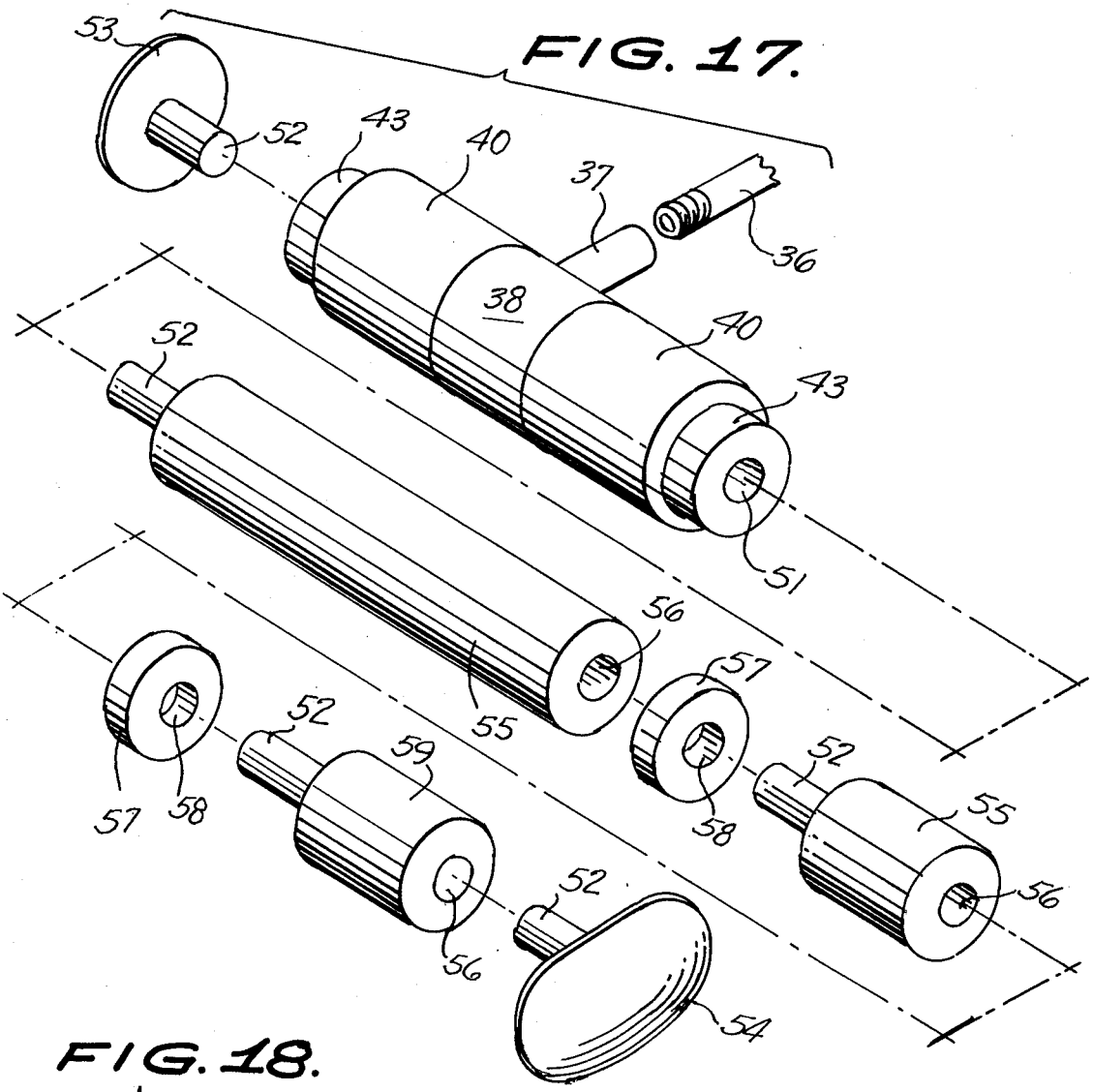
FIG. 17 is an exploded perspective view of the structure illustrated in FIG. 16.

Referring now to the drawings in detail wherein like reference characters indicate like parts throughout the several figures the reference numeral 30 indicates generally the pressure applying apparatus of the instant invention.

The pressure applying apparatus 30 includes a compressed air bottle 31 or if desired a source of hydraulic fluid under pressure which is controlled by a valve 32 having a hand knob 33 associated therewith. A fitting 34 extends upwardly from the valve 32 and has a pressure gauge 35 mounted thereon. An elongate handle tube 36 is connected to the fitting 34 and extends to a fitting 37 forming part of a base member 38.

The base member 38 is generally cylindrical in cross section and is internally threaded at 39 for reasons to be assigned.

A hollow cylinder 40 has an externally threaded reduced diameter portion 41 at one end thereof which is threaded into the threads 39 of the base member 38 on each side thereof. The hollow cylinder 40 has an internal flange 42 formed at the end thereof opposite the externally threaded reduced diameter portion 41 for reasons to be assigned.

Figure 18:
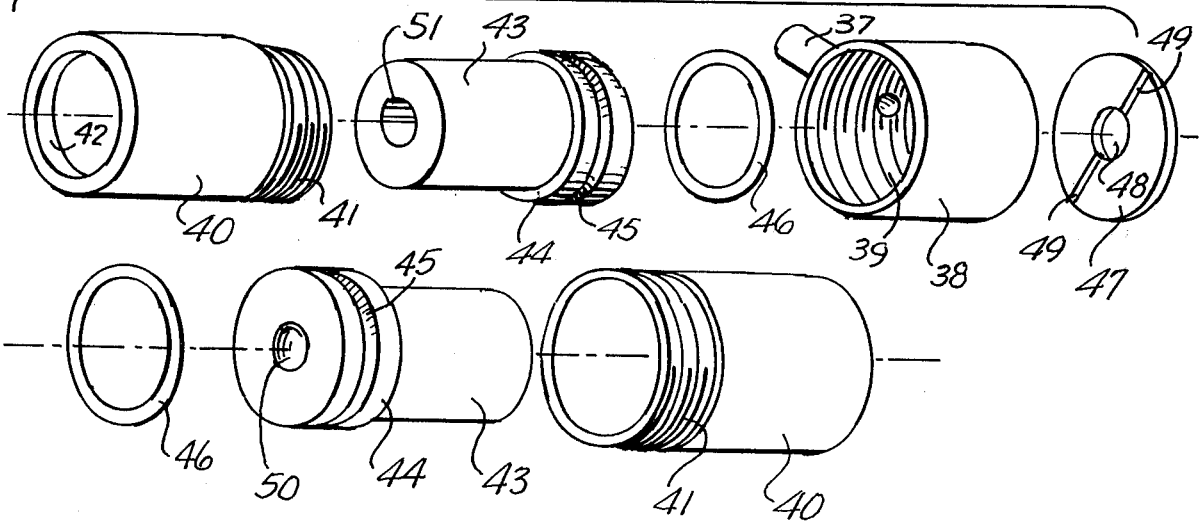
FIG. 18 is an exploded perspective view of the central unit of the apparatus.

A piston 43 is mounted for reciprocation in the cylinder 40 and has a shouldered portion 44 which engages the flange 42 to prevent the piston 43 from moving completely out of the cylinder 40. The shouldered portion 44 has an annular groove 45 formed therein to receive an O-ring seal 46 as can be clearly seen in FIGS. 2 and 18. A washer 47 having an axial bore 48 formed therein is positioned between the cylinders 40 centrally of the body 38. The opposite faces of the washer 47 are provided with radial grooves 49 to permit the flow of fluid from fitting 37 inwardly to the central bore 48. The inner ends of the pistons 43 have a recess 50 formed therein to permit the free flow of fluid from the bore 48.

The outer ends of the pistons 43 are provided with bores 51 to receive cylindrical bodies 52 for reasons to be assigned.

A generally circular knurled contact member 53 has a cylindrical body member 52 integrally formed thereon as can be seen in FIGS. 4 and 5. An elongate domed member 54 also knurled on it's outer surface is similarly provided with a cylindrical body 52. The numbers 53, 54 are used interchangeably in accordance with the shape to be given to the foot gear as it is expanded.

In some instances the effective length between the cylinders 40 must be increased and this is done with an adaptor 55 having a body 52 formed on one end thereof and a bore 56 formed in the opposite end thereof. A washer 57 having a bore 58 therein permits relatively short additions to be made to the length of the apparatus. An immediate adaptor 59 is identical to the adaptor 55 with the exception that it is shorter in overall length. As can be seen in FIGS. 8 through 17 the effective length between cylinders 40 can be varied to any degree necessary in order to adapt the apparatus to the foot gear needing shaping.

In some instances when found desirable to have expansion from only one side of the body 38 one of the cylinders 40 can be replaced with a dummy cylinder 40 solid at its inner end instead of having the piston 43 mounted therein.

Figure 20:
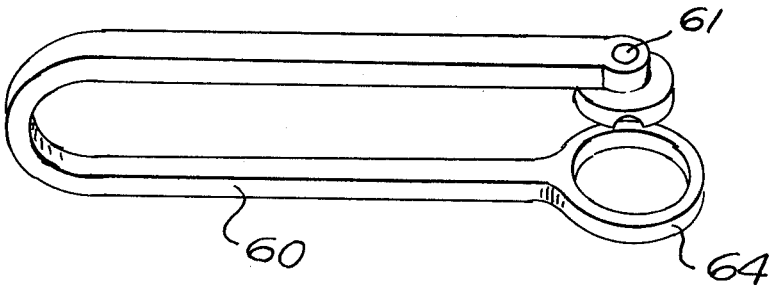
FIG. 20 is a perspective view of the C-member illustrated in FIG. 19.
Figure 19:
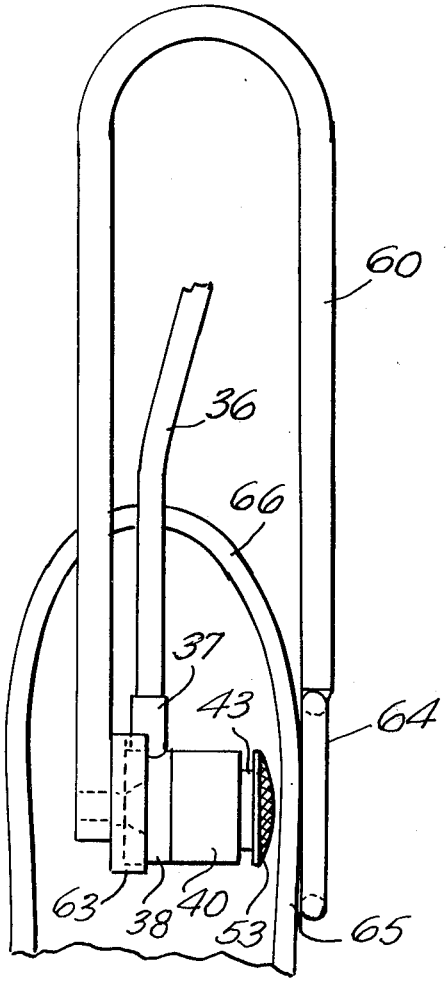
FIG. 19 is a side elevation of another modified form of the invention shown in boot shaping position.
Figure 21:
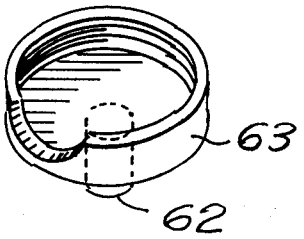
FIG. 21 is a perspective view of the adaptor element shown in FIG. 19.

In FIGS. 19 through 21 a generally U-shaped unit 60 is provided at one end with a bore 61 adapted to receive a post 62 of a generally cylindrical base member 63. The opposite end of the unit 60 is provided with an open ring 64 which is adapted to engage the outer face 65 of foot gear 66 to be shaped. The body 38 is seated in the base member 63 and has a cylinder 40 mounted therein supporting a piston 43 and a dome member 53 as can be best seen in FIG. 19. In the form of the invention illustrated in FIGS. 19 through 21 the foot gear is heated in the area to be expanded and the dome shaped member 53 is pressed toward the ring 64 centrally thereof so as to reshape the foot gear 66 as needed.

The method of shaping foot gear with the instant invention is practiced as follows.

1. The apparatus is placed in the foot gear and a limited amount of pneumatic or hydraulic pressure is applied through the body 38 to expand the pistons 40 bringing the dome members 53 into contact with the area to be expanded and a point directly opposite. A hot air gun is then used to heat the area to be expanded until the material of the foot gear is sufficiently softened. Additional pressure is then applied to the pistons so as to expand the foot gear in the softened area to the desired shape. The foot gear is then allowed to cool following which the apparatus is removed with the expansion complete.

Having thus described the preferred embodiment of the invention it should be understood that numerous structural modifications and adaptations may be resorted to without departing from the spirit of the invention.

what is claimed is:

1. A method of locally shaping foot gear by outward expansion of a local portion of the foot gear including the step of inserting a fluid pressure expansible member into the foot gear with one movable end engaged against the area to be expanded and the opposite end engaged against a portion of the foot gear opposite the area to be expanded, applying heat to the outer surface only of the area to be expanded, applying fluid pressure to the expansible member to expand the area to be expanded and permitting the foot gear to cool while maintaining the expansion of the expansible member.

* * * * *